US008080357B2

(12) United States Patent
Ochiai et al.

(10) Patent No.: US 8,080,357 B2
(45) **Date of Patent: *Dec. 20, 2011**

(54) EXTERNAL ADDITIVE FOR TONER AND METHOD FOR PRODUCING THE SAME

(75) Inventors: Kazuo Ochiai, Kouriyama (JP); Shinji Tanabe, Tokyo (JP); Naoaki Narishige, Ichikawa (JP)

(73) Assignee: Nippon Chemical Industrial Co., Ltd., Tokyo (JP)

( * ) Notice: Subject to any disclaimer, the term of this patent is extended or adjusted under 35 U.S.C. 154(b) by 96 days.

This patent is subject to a terminal disclaimer.

(21) Appl. No.: 12/162,653

(22) PCT Filed: Jan. 25, 2007

(86) PCT No.: PCT/JP2007/051146

§ 371 (c)(1),
(2), (4) Date: Oct. 2, 2008

(87) PCT Pub. No.: WO2007/086451

PCT Pub. Date: Aug. 2, 2007

(65) Prior Publication Data

US 2009/0134356 A1 May 28, 2009

(30) Foreign Application Priority Data

Jan. 30, 2006 (JP) ..... 2006-020182

(51) Int. Cl.

| | |
|---|---|
| ***G03G 13/08*** | (2006.01) |
| ***G03G 9/00*** | (2006.01) |
| ***G03G 13/10*** | (2006.01) |
| ***G03C 11/18*** | (2006.01) |
| ***G03C 7/46*** | (2006.01) |

(52) U.S. Cl. ..... 430/123.51; 430/106.1; 430/106.3; 430/108.1; 430/111.3; 430/118.8; 370/376

(58) Field of Classification Search ..... 252/182.33, 252/308, 309; 516/20; 430/108.23, 123.51, 430/106.1, 106.3, 108.1, 111.3, 118.8, 370, 430/376

See application file for complete search history.

(56) References Cited

U.S. PATENT DOCUMENTS

| | | | | |
|---|---|---|---|---|
| 5,561,019 | A | 10/1996 | Yuasa et al. | |
| 5,702,858 | A | 12/1997 | Yuasa et al. | |
| 6,051,614 | A * | 4/2000 | Hirai et al. | 516/20 |
| 6,383,703 | B1 | 5/2002 | Asano et al. | |
| 7,378,207 | B2 * | 5/2008 | Oyama et al. | 430/108.23 |
| 2002/0090335 | A1 * | 7/2002 | Harada et al. | 423/598 |
| 2002/0115008 | A1 | 8/2002 | Suzuki et al. | |
| 2003/0186155 | A1 * | 10/2003 | Aoki et al. | 430/111.4 |
| 2004/0197693 | A1 | 10/2004 | Ninomiya et al. | |
| 2009/0117385 | A1 * | 5/2009 | Ochiai et al. | 428/402.2 |

FOREIGN PATENT DOCUMENTS

| | | | |
|---|---|---|---|
| JP | 5-330824 | A | 12/1993 |
| JP | 7-295282 | A | 11/1995 |
| JP | 7-306542 | A | 11/1995 |
| JP | 7-306543 | A | 11/1995 |
| JP | 2001-66820 | A | 3/2001 |
| JP | 2002-107999 | A | 10/2002 |
| JP | 2004-26641 | A | 1/2004 |
| JP | 2004-287197 | * | 10/2004 |
| JP | 2004-287197 | A | 10/2004 |
| JP | 2005-55609 | A | 3/2005 |
| JP | 2005-289668 | A | 10/2005 |
| JP | 2005-306691 | A | 11/2005 |
| JP | 2005-316225 | A | 11/2005 |
| JP | 2005-316226 | A | 11/2005 |

OTHER PUBLICATIONS

English Language Abstract of JP 2005-316226 A.
English Language Abstract of JP 2005-316225 A.
English Language Abstract of JP 2005-55609 A.
English Language Abstract of JP 7-295282 A.
English Language Abstract of JP 2004-287197 A.
English Language Abstract of JP 2001-66820 A.
English Language Abstract of JP 2004-26641 A.
English Language Abstract of JP 2005-306691 A.
English Language Abstract of JP 5-330824 A.
English Language Abstract of JP 2005-289668 A.
English Language Abstract of JP 7-306542 A.
English Language Abstract of JP 7-306543 A.
English Language Abstract of JP 2002-107999 A.
U.S. Appl. No. 12/652,652 to Ochiai et al., I.A. filed Jan. 25, 2007 and entitled "External Additive for Toner and Method for Producing the Same".

* cited by examiner

*Primary Examiner* — Ling Choi

*Assistant Examiner* — Monique Peets

(74) *Attorney, Agent, or Firm* — Greenblum & Bernstein, PLC

(57) ABSTRACT

When being blended particularly in a color toner, a barium titanate external additive for toner enhances the toner fluidity, electrical properties, and other relevant performance; concurrently achieves high image density and reduced background fog in a color printer using the toner; and further retains high image quality even under a high-temperature high-humidity environment and a low-temperature low-humidity environment. An industrially advantageous producing method of the barium titanate external additive for toner is also provided. The external additive for toner of the present invention includes spherical barium titanate having undergone coating treatment with a hydrophobicizing agent.

6 Claims, 1 Drawing Sheet

EXTERNAL ADDITIVE FOR TONER AND METHOD FOR PRODUCING THE SAME

BACKGROUND OF THE INVENTION

1. Field of the Invention

The present invention relates to a barium titanate external additive for toner and a method for producing the same.

2. Description of Related Art

With increasing printer speed and improving image quality in recent years, it has been performed, in terms of enhancement of toner fluidity, electrical properties, and cleaning performance, that inorganic or organic external additives in fine powder form are adhered to a toner surface so as to enhance the toner fluidity.

It is proposed in addition, that barium titanate is used as the external additives. Proposed methods use, for example, barium titanate produced in an oxalate method and having an average particle size of 0.1 μm to 4 μm and a BET specific surface area of 0.5 $m^2/g$ to 20 $m^2/g$ (refer to Related Arts 1 to 3, for example); barium titanate produced in a liquid phase method and having a BET specific surface area of 0.5 $m^2/g$ to 5 $m^2/g$ (refer to Related Art 4, for example); and the like. It is desired, however, to develop barium titanate for external additives that can also meet further increasing printer speed and improving image quality.

[Related Art 1] Japanese Patent Laid-open Publication H7-306542

[Related Art 2] Japanese Patent Laid-open Publication H7-295282

[Related Art 3] Japanese Patent Laid-open Publication H7-306543

[Related Art 4] Japanese Patent Laid-open Publication 2002-107999

SUMMARY OF THE INVENTION

As a result of extensive research in order to address the above-described problems, the inventors of the present invention found that blending spherical barium titanate having undergone coating treatment with a hydrophobicizing agent in a color toner, in particular, enhances the toner fluidity, electrical properties, and other relevant performance; concurrently achieves high image density and reduced background fog in a color printer using the toner; and further retains high image quality even under a high-temperature high-humidity environment and a low-temperature low-humidity environment. Thereby, the inventors completed the present invention.

Specifically, the present invention is intended to provide a barium titanate external additive for toner that, when being blended particularly in a color toner, enhances the toner fluidity, electrical properties, and other relevant performance; concurrently achieves high image density and reduced background fog in a color printer using the toner; and further retains high image quality even under a high-temperature high-humidity environment and a low-temperature low-humidity environment. The present invention is also intended to provide an industrially advantageous producing method of the barium titanate external additive for toner.

The external additive for toner according to the present invention includes spherical barium titanate having undergone coating treatment with a hydrophobicizing agent. The producing method of the external additive for toner according to the present invention includes a first process, in which titanium hydroxide, which is obtained from hydrolysis of titanium alkoxide by water, and a barium compound are reacted in a solvent containing water and alcohol; a second process, in which the product obtained in the first process is heat-treated at a temperature of 400° C. to 1,000° C., so as to obtain spherical barium titanate; and a third process, in which the spherical barium titanate and a hydrophobicizing agent are contacted.

DETAILED DESCRIPTION OF PREFERRED EMBODIMENTS

Figure 1:
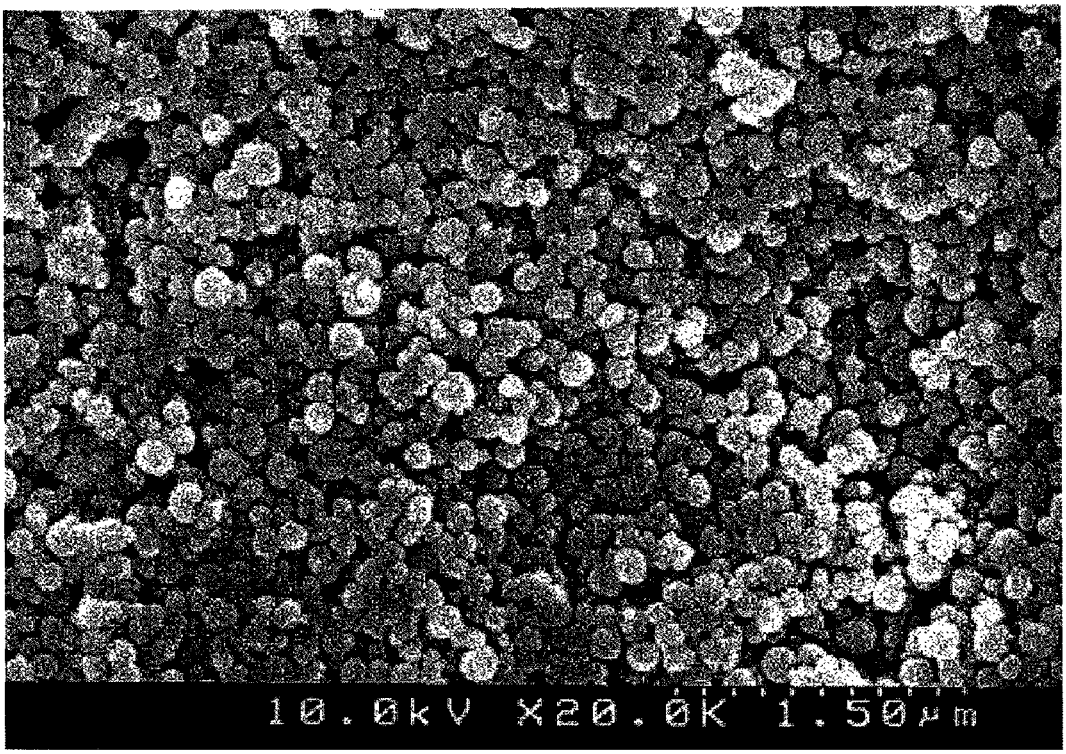
FIG. 1 is an electron microscope photograph illustrating a particle shape of barium titanate Sample 1.

The present invention is explained below based on preferred embodiments. An external additive for toner according to the present invention includes spherical barium titanate having undergone coating treatment with a hydrophobicizing agent. The external additive having the above-described structure provides a color toner, in particular, with excellent toner fluidity, electrical properties, and other relevant performance; concurrently achieves high image density and reduced background fog in a color printer using the toner; and further retains high image quality even under a high-temperature high-humidity environment and a low-temperature low-humidity environment.

The spherical barium titanate in the present invention represents that, when the barium titanate having undergone coating treatment with a hydrophobicizing agent is used as the external additive for toner in a form of monodispersed primary particles, the primary particles of barium titanium themselves have a spherical shape; and that, when the barium titanate having undergone coating treatment with a hydrophobicizing agent is used as the external additive for toner in a form of aggregates of fine primary particles, the aggregates themselves have a spherical shape.

In the present invention, the barium titanate having a spherical shape is used, which is represented as a sphericity of a range from 1.0 to 1.4, as defined below. In the present invention, it is particularly preferable that the spherical barium titanate have a perfect spherical shape. The sphericity of the spherical barium titanate is preferably in a range from 1.0 to 1.3, and particularly preferably from 1.0 to 1.25, thereby further enhancing the fluidity and other physical properties of a toner blended with the external additive.

In addition to the above-described sphericity range, surface roughness (defined below) of the spherical barium titanate is in a range from 1.0 to 1.4, preferably from 1.0 to 1.3, and more preferably from 1.0 to 1.25, thereby further enhancing the fluidity of the toner blended with the external additive and adhesion performance to toner resin.

Parameters used for the sphericity and surface roughness in the present invention are obtained from image analysis processing of 100 particles randomly sampled when samples are observed using an electron microscope at a magnification of 10,000 to 30,000 times. More specifically, the sphericity is represented as an average value of 100 particles obtained by Formula (1) below; and the surface roughness is represented as an average value of 100 particles obtained by Formula (2) below.

$$\text{Sphericity} = \text{Perfect circle area formed by a maximum diameter}/\text{Actual surface area} \quad (1)$$

$$\text{Surface roughness} = \text{Perfect circle area forming a boundary length}/\text{Actual surface area} \quad (2)$$

An image analyzing device used for the image analysis processing is not particularly limited. For instance, Luzex AP (Nireco Corporation) may be used. The closer a value of the sphericity is to 1, the closer the shape is to a perfect sphere. The closer a value of the surface roughness is to 1, the closer the shape is to a perfect sphere and the smoother a particle surface is.

In addition to that the external additive for toner according to the present invention uses barium titanate having the above-described spherical shape, it is preferable to use spherical barium titanate having a physical property of 5.6 g/ml or less in specific gravity, preferably 5.55 g/ml or less. More specifically, barium titanate produced in a regular method has a specific gravity of a range from 5.7 g/ml to 6.0 g/ml after calcination. Since the spherical barium titanate used in the present invention has a specific gravity of 5.6 g/ml or less, preferably 5.55 g/ml or less, however, it is preferable to use barium titanate having a lower specific gravity than a conventional barium titanate external additive. Using spherical barium titanate having a low specific gravity further increases an adhesion ratio to toner resin and enhances image performance, including high image density and reduced background fog, of a color printer using the toner. Since it is technically difficult to produce barium titanate having a specific gravity of less than 5.0 g/ml, it is particularly preferable to use barium titanate having a specific gravity of a range from 5.0 g/ml to 5.55 g/ml in the present invention.

Another preferable physical property of the spherical barium titanate that can be used as the external additive for toner of the present invention, is that the used spherical barium titanate has an average particle size, which is obtained from a scanning electron microscope, of a range from 0.05 μm to 0.7 μm, preferably from 0.1 μm to 0.5 μm. The size range is preferable because spherical barium titanate having an average particle size of less than 0.05 μm causes secondary aggregation with each other. There is thus a tendency to prevent a highly-dispersed product having a high sphericity from being produced. Meanwhile, when the average particle size exceeds 0.7 μm, the adhesion performance to toner resin declines. There is thus a tendency to reduce the intended effects of the present invention.

When the barium titanate having undergone coating treatment with a hydrophobicizing agent is used as the external additive for toner in a form of monodispersed primary particles, the average particle size represents an average particle size of the primary particles of barium titanium themselves. When the barium titanate having undergone coating treatment with a hydrophobicizing agent is used as the external additive for toner in a form of aggregates of fine primary particles, the average particle size represents an average particle size of the aggregates themselves.

In addition, it is preferable that the spherical barium titanate have a BET specific surface area of 3 $m^2/g$ to 20 $m^2/g$, preferably 4 $m^2/g$ to 15 $m^2/g$. Using the spherical barium titanate having a BET specific surface area of the range further enhances the adhesion performance to toner resin.

Examples of the hydrophobicizing agent for coating treatment of the spherical barium titanate in the present invention include organic acids, such as fatty acids, alicyclic carboxylic acids, aromatic carboxylic acids, sulfonic acids of compounds of the above-listed substances, resin acids, and the like; metal salts, amine salts, and esters of the organic acids; silane coupling agents; titanate coupling agents; silicone oils; paraffins; and the like. The above-listed substances can be used alone, or in combination of two or more types when necessary.

Examples of the above-described fatty acids, alicyclic carboxylic acids, aromatic carboxylic acids, and resin acids include saturated fatty acids, including a caproic acid, a caprylic acid, a capric acid, a lauric acid, a myristic acid, a palmitic acid, a stearic acid, an arachidic acid, a behenic acid, a lignoceric acid, and the like; unsaturated fatty acids, including a sorbic acid, an elaidic acid, a palmitoleic acid, an oleic acid, a linoleic acid, a linolnic acid, a cetoleic acid, an erucic acid, a ricinolic acid, and the like; alicyclic carboxylic acids, including a naphthenic acid having a cyclopentane ring or a cyclohexane ring, and the like; aromatic carboxylic acids, including benzenecarboxylic acids, represented by an acetic acid, a butyric acid, a benzoic acid, a phthalic acid, and the like, and naphthalenecarboxylic acids, including a naphthoic acid, a naphthalic acid, and the like; and resin acids, including an abietic acid, a pimaric acid, a parastrinic acid, a neoabietic acid, and the like. Examples of the above-described metal salts and amine salts of fatty acids, alicyclic carboxylic acids, aromatic carboxylic acids, and resin acids include saturated fatty acid salts, including potassium laurate, potassium myristate, potassium palmitate, sodium, barium stearate, calcium, zinc, potassium, cobalt (II), tin (IV), sodium, lead (II), and the like; unsaturated fatty acid salts, including zinc oleate, potassium, cobalt (II), sodium, a potassium diethanolamine salt, and the like; alicyclic carboxylic acid salts, including lead naphthenate, lead cyclohexylbutyrate, and the like; and aromatic carboxylic acid salts, including sodium benzoate, sodium salicylate, and the like. Examples of the above-described esters of fatty acids, alicyclic carboxylic acids, aromatic carboxylic acids, and resin acids include saturated fatty acid esters, including ethyl caproate, vinyl caproate, diisopropyl adipate, ethyl caprylate, allyl caprate, ethyl caprate, vinyl caprate, diethyl sebacate, diisopropyl sebacate, cetyl isooctanate, octyldodecyl dimethyloctanate, methyl laurate, butyl laurate, lauryl laurate, methyl myristate, isopropyl myristate, cetyl myristate, myristyl myristate, isocetyl myristate, octyldodecyl myristate, isotridecyl myristate, methyl palmitate, isopropyl palmitate, octyl palmitate, cetyl palmitate, isostearyl palmitate, methyl stearate, butyl stearate, octyl stearate, stearyl stearate, cholesteryl stearate, isocetyl isostearate, methyl behenate, behenyl, and the like; unsaturated fatty acid esters, including methyl oleate, ethyl linoleate, isopropyl linoleate, ethyl olive oleate, methyl erucate, and the like; thermostable special fatty acid esters, including a long-chain fatty acid higher alcohol ester, a neopentyl polyol (including long chain and medium chain) fatty acid ester and partial ester compound, a dipentaerythritol long-chain fatty acid ester, a complex medium-chain fatty acid ester, 12-isocetyl stearoylstearate, isostearyl, stearyl, a tallow fatty acid octyl ester, a polyalcohol fatty acid ester/a fatty acid ester of alkyl glyceryl ether, and the like; and aromatic esters, represented by benzoate esters. Examples of the above-described fatty, alicyclic, and aromatic sulfonic acids include sulfonic acids, including a sulfosuccinic acid, dioctyl sulfosuccinate, lauryl sulfoacetate, a tetradecene sulfonic acid, and the like; an alkyl sulfuric acid, comprising an alkyl group of lauryl, myristyl, palmitin, stearin, olein, cetyl, or the like; polyoxyethylene alkyl ether sulfates, including polyoxyethylene (2) laurylether sulfate, polyoxyethylene (3) laurylether sulfate, polyoxyethylene (4) laurylether sulfate, polyoxyethylene (3) alkyl ether sulfate, polyoxyethylene (4) nonylphenyl ethereal sulfate, and the like; and aromatic sulfonic acids, including linear (C10, C12, C14) alkylbenzenesulfonate, branched alkylbenzenesulfonate, naphthalenesulfonate, dodecylbenzenesulfonate, and the like. Examples of the above-described metal salts of fatty, alicyclic, and aromatic sulfonic acids include sodium salts of the above-described fatty, alicyclic, and aromatic sulfonic acids.

Examples of the silane coupling agents include γ-(2-aminoethyl)-aminopropyltrimethoxysilane, γ-(2-aminoethyl)-aminopropylmethyldimethoxysilane, aminosilane, γ-aminopropyltriethoxysilane, N-(2-aminoethyl)-3-aminopropyltrimethoxysilane, N-β-(N-vinylbenzylaminoethyl)-γ-aminopropyltrimethoxysilane, hexamethyldisilazane, trimethylsilane, trimethylchlorsilane, dimethyldichlorsilane, methyltrichlorsilane, allyldimethylchlorsilane, benzyldimethylchlorsilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane, vinyltriacetoxysilane, γ-chloropropyltrimethoxysilane, β-(3,4-epoxycyclohexyl)-ethyltrimethoxysilane, γ-glycidoxypropyltrimethoxysilane, γ-mercaptopropyltrimethoxysilane, N-β-(aminoethyl)-γ-aminopropyltrimethoxysilane, γ-ureidopropyltriethoxysilane, amino fluorosilane, and the like.

The titanate coupling agents may have a side chain type of amino, phosphorous acid, pyrophosphoric acid, and carboxylic acid. Examples of the titanate coupling agents include isopropyltriisostearoyl titanate, isopropyltridodecylbenzene sulfonyl titanate, isopropyl tris(dioctylpyrophosphate) titanate, tetraoctyl bis(ditridecyl phosphite) titanate, tetra(2,2-diallyloxymethyl-1-butyl) bis(di-tridecyl) phosphite titanate, bis(dioctylpyrophosphate) oxyacetate titanate, bis(dioctylpyrophosphate) ethylene titanate, isopropyltrioctanoyl titanate, isopropyl dimethacryl isostearoyl titanate, isopropyl isostearoyl diacryl titanate, isopropyl tri(dioctylphosphate) titanate, isopropyl tricumylphenyl titanate, isopropyl tri(N-aminoethyl-aminoethyl) titanate, dicumylphenyloxyacetate titanate, diisostearoylethylene titanate, polydiisopropyl titanate, tetranormalbutyl titanate, polydinormalbutyl titanate, and the like.

In the present invention, the silane coupling agents are particularly preferable for use among the above-listed hydrophobicizing agents, since the silane coupling agents have a wide variety of hydrophobic groups and a good affinity for a variety of toner resins.

A preferable coating amount of the hydrophobicizing agent is 0.5% to 5% by weight with respect to spherical barium titanate, and a more preferable amount is 1% to 3% by weight. The above-described amount is preferable because, when the coating amount of the hydrophobicizing agent is less than 0.5% by weight, the hydrophobicizing agent covers less than ¾ of a surface area of spherical barium titanate. There is thus a tendency to prevent the additive effect from developing. When the coating amount exceeds 5% by weight, secondary aggregation is accelerated. There is thus a tendency to cause problems, such as granulation, in a process of mixing and dispersing with toner resin.

The above-described external additive for toner according to the present invention may be produced in a method, in which barium titanate is obtained basically in a wet method, such as a hydrothermal synthesis method, an alkoxide method, and the like; thereafter, the barium titanate is heat-treated at a temperature of 400° C. to 1,000° C., whereby spherical barium titanate is produced; and then the spherical barium titanate and a hydrophobicizing agent are contacted. It is preferable, however, that external additive for toner be produced in a first process, in which titanium hydroxide obtained from hydrolysis of titanium alkoxide by water, and a barium compound are reacted in a solvent containing water and alcohol, so as to obtain barium titanate (hereinafter referred to as a "spherical barium titanate precursor"); subsequently, in a second process, in which the spherical barium titanate precursor is heat-treated at a temperature of 400° C. to 1,000° C., so as to obtain spherical barium titanate; and then in a third process, in which the spherical barium titanate and a hydrophobicizing agent are contacted. The producing method is particularly preferable since the method provides, in particular, an external additive excellent in sphericity and surface roughness.

The producing method of the external additive for toner according to the present invention is explained below. The first process is to obtain a spherical barium titanate precursor, by reacting titanium hydroxide, which is obtained from hydrolysis of titanium alkoxide by water, and a barium compound in a solvent containing water and alcohol. In the first process, it is important to produce a spherical barium titanate precursor having excellent sphericity and surface roughness in particular. Using the spherical barium titanate precursor having excellent sphericity and surface roughness in the second and third processes (described hereinafter) provides the external additive of the present invention having particularly excellent sphericity and surface roughness.

The titanium hydroxide used in the first process is obtained by hydrolyzing titanium alkoxide by water. Examples used as the titanium alkoxide may include titanium methoxide, titanium ethoxide, titanium propoxide, titanium isopropoxide, titanium butoxide, and the like. Titanium butoxide is preferable for use among the above-listed substances, in view of easy industrial availability, good stability of the material itself, and physical properties, such as easy handling of separately formed butanol and the like. The titanium alkoxide may also be used in a form of a solution, in which the substance is dissolved in a solvent, such as alcohol, toluene, hexane, and the like. To hydrolyze titanium alkoxide by water, titanium alkoxide and water only need to be contacted following a common procedure. For instance, water is added to a solution containing titanium alkoxide. Water in the hydrolysis reaction is added in an amount at a mole ratio of twice or more with respect to titanium alkoxide, preferably at a mole ratio of twenty times or more. The hydrolysis is preferably performed at a temperature of 10° C. to 80° C., preferably 20° C. to 70° C.

Thereby, the hydrolysis of titanium alkoxide provides a suspension containing titanium hydroxide, alcohol, and water. In the present invention, the suspension can be used as it is, as one component of Solution A, which contains titanium hydroxide, alcohol, and water, in the first process (described hereinafter).

Subsequently, the titanium hydroxide obtained as above and a barium compound are reacted in a solvent containing water and alcohol.

Examples used as the barium compound may include barium hydroxide, barium chloride, barium nitrate, barium acetate, barium alkoxide, and the like. Barium hydroxide is particularly preferable among the above-listed substances, since the substance has basicity that accelerates the reaction and it is inexpensive.

As the alcohol to be contained in the solvent containing water, one type, or two or more types, may be used from methanol, ethanol, propanol, isopropanol, butanol, and the like. It is preferable to use the same alcohol as alcohol secondarily produced along with titanium hydroxide in the hydrolysis of titanium alkoxide.

In the first process, it is preferable that titanium hydroxide and the barium compound be reacted in a solvent containing 10 to 400 parts by weight of alcohol, preferably 30 to 100 parts by weight, with respect to 100 parts by weight of water, in order to obtain a spherical barium titanate precursor having particularly excellent sphericity and surface roughness. Thus, it is particularly preferable that Solution B be added to Solution A in the reaction of the first process, such that 10 to 400 parts by weight of alcohol (A1), preferably 30 to 100 parts by weight, is provided with respect to 100 parts by weight of water (A2+B1), the Solution B containing the barium compound and water (B1), the Solution A containing the titanium hydroxide, which is obtained from the hydrolysis of titanium alkoxide by water, alcohol (A1), and water (A2). Thereby, a spherical barium titanate precursor having excellent sphericity and surface roughness is provided in an industrially advantageous manner. As described above, the suspension, which contains the titanium hydroxide obtained from the hydrolysis of titanium alkoxide by water, alcohol, and water, can be used as it is, as one component of Solution A used in the first process.

In the first process of the present invention, the formation reaction of the barium titanate precursor progresses at a pH of 10 or greater. Unless an alkaline compound, such as barium hydroxide or the like, is used as the barium compound, namely, when barium chloride, barium nitrate, barium acetate, or the like, for example, is used as the barium compound, it is preferable, after the barium compound is added to Solution A, to add an alkaline chemical for ordinary use, such as ammonia, sodium hydrate, and the like, to the reaction solution when necessary, in order to control the pH to 10 or greater, preferably 12 to 14.

As a reaction condition for the first process, it is preferable that the barium compound be added in an amount at a mole ratio of Ba in the barium compound with respect to Ti in a titanium compound (Ba/Ti) of 1.0 to 1.5, preferably 1.1 to 1.2, in order to easily control barium titanate in a stoichiometric ratio. Conversely, it is not preferable that the mole ratio be less than 1.0, since barium is insufficient with respect to the stoichiometric ratio; and that the mole ratio exceed 1.5, since a washing process is long, in which excessive barium with respect to the stoichiometric ratio is washed.

Further controlling reaction conditions, such as a reaction temperature, a temperature increase rate, and the like, for the reaction of the first process provides a spherical barium titanate precursor having a sharp particle size distribution, a desired average particle size, and excellent sphericity and surface roughness.

Specifically, the reaction in the first process of the present invention is performed at a reaction temperature of 10° C. to 100° C., preferably 20° C. to 90° C. In a temperature range from 10° C. to 60° C., preferably from 50° C. to 60° C., a fine barium titanate precursor is produced. When the temperature is gradually increased therefrom to a temperature of 80° C. to 100° C., and then the temperature is retained at 80° C. to 100° C. and the reaction is performed 0.5 to 24 hours, preferably 1 to 10 hours, a spherical aggregate of the fine barium titanate precursor is produced. For the temperature increase, it is preferable that a temperature increase rate be 5° C. to 50° C. per hour, preferably 10° C. to 30° C. per hour, in order to strike a balance between a process time and equipment load, and to provide spherical barium titanate having a sharp particle size distribution and excellent sphericity and surface roughness. After the reaction, a spherical barium titanium precursor can be obtained by solid-liquid separation, and washing when necessary.

The second process is to obtain spherical barium titanate, by heat-treating the spherical barium titanium precursor at a temperature of 400° C. to 1,000° C., preferably 600° C. to 900° C. In the second process of the present invention, the heating temperature range is specified as above because, when the heating temperature is less than 400° C., an organic material residue may remain in a wet process; and, when the heating temperature exceeds 1,000° C., the sphericity, surface roughness, and further specific gravity of produced spherical barium titanate are adversely affected.

The heat treatment may be performed in an atmosphere or in an inert gas atmosphere, and not limited to a particular atmosphere. It is preferable that a heating duration be 2 to 30 hours, preferably 4 to 10 hours. In the present invention, the heat treatment may be performed as many times as desired, and may be performed while heating and grinding are repeated.

After the heating, spherical barium titanate can be obtained by cooling, and grinding and classification when necessary. The spherical barium titanate obtained as above has the following physical properties: an average particle size obtained from a scanning electron microscope of 0.05 μm to 0.7 μm, preferably 0.1 μm to 0.5 μm; a content of particles having a particle size of 1 μm or greater of 10% by weight or less, preferably 5% by weight or less; a BET specific surface area of 3 $m^2/g$ to 20 $m^2/g$, preferably 4 $m^2/g$ to 15 $m^2/g$; both a sphericity and a surface roughness of 1.0 to 1.4, preferably 1.0 to 1.3, and particularly preferably 1.0 to 1.25; and a specific gravity of 5.6 g/ml or less, preferably 5.5 g/ml or less, and particularly preferably 5.0 g/ml to 5.5 g/ml.

Subsequently, in the third process, the spherical barium titanate obtained in the previous process and a hydrophobicizing agent are contacted, so that the spherical barium titanate undergoes coating treatment with the hydrophobicizing agent. The spherical barium titanate and the hydrophobicizing agent may be contacted in a wet method or in a dry method. In the wet method, the spherical barium titanate is immersed in a solvent containing the hydrophobicizing agent at a desired concentration. Then, the spherical barium titanate is spray dried along with the solvent, or undergoes solid-liquid separation and is dried. Thereby, the external additive of the present invention can be obtained, the external additive being the spherical barium titanate having undergone coating treatment with the hydrophobicizing agent. On the other hand, in the dry method, the hydrophobicizing agent and the spherical barium titanate are sufficiently mixed in a dry process by using a Henschel mixer or the like. Alternatively, the hydrophobicizing agent is diluted with a solvent; the diluent is added to and mixed with the spherical barium titanate; and the mixture is heated and dried. Thereby, the external additive of the present invention can be obtained, the external additive being the spherical barium titanate having undergone coating treatment with the hydrophobicizing agent. As described above, it is preferable to control an additive amount of the hydrophobicizing agent, so as to be 0.5% to 5% by weight, preferably 1% to 3% by weight, with respect to the spherical barium titanate.

The external additive for toner according to the present invention can be used in an electrophotographic method that uses a magnetic single-component toner, a two-component toner, a non-magnetic toner, or the like. A producing method is not particularly limited, and a toner may be produced, for example, in a grinding method or a polymerization method. As binding resin for toner, publicly-known synthetic resin or natural resin may be used, including, for example, styrene resin, acrylic resin, olefin resin, diene resin, polyester resin, polyvinylchloride, maleic acid resin, polyvinyl acetate, polyvinyl butyral, rosin, terpene resin, xylene resin, polyamide resin, epoxy resin, silicone resin, phenol resin, petroleum resin, urethane resin, and the like. One type, or two or more types, from the above-listed substances may be used, and the binding resin for toner is not limited to the above-listed substances. Further, the toner may be added with additives in binding resin, the additives having conventionally been used in the toner field, including a charging regulator, a parting agent, magnetic powders, a colorant, a conductive additive, a lubricant, and the like.

The external additive according to the present invention can be used by adding to a toner for 0.01% to 20% by weight, preferably 0.1% to 5% by weight. In addition, the external additive of the present invention can be used concurrently with another flow modifier. Examples of the another flow modifier may include inorganic powders, including hydrophobic silica, alumina, titanium oxide, cerium oxide, zirconium oxide, boron nitride, silicon carbide, and the like; and fine powders, including an aliphatic metal salt, polyvinylidene-fluoride, polyethylene, and the like. One type, or a combination of two or more types, from the above-listed substances may be used.

It is preferable that the external additive of the present invention be mixed with and added to (externally added to) the toner, such that a uniform mixture of toner particles and the external additive of the present invention is achieved. It is thus preferable that the external additive of the present invention be added to the toner particles for 0.01% to 20% by weight, preferably 0.1% to 5% by weight, and be mixed therewith uniformly by using a mixer, such as a Henschel mixer and the like.

EMBODIMENTS

The present invention is explained in detail below in the embodiments. The present invention, however, is not limited to the embodiments. In the embodiments, physical properties of barium titanate samples were evaluated as described below.

(Granularity Characteristics)

An average particle size was obtained as an average value from a scanning electron microscope photograph of randomly sampled 1,000 particles.

(Specific Surface Area)

The specific surface area was measured in a common method using a BET method monosorb specific surface area measurement device.

(Shape Factor)

The shape factor was calculated from parameters, which were obtained from image analysis of randomly sampled 100 particles using an image analyzing device Luzex AP (Nireco Corporation). The sphericity was obtained as an average value from a calculation of (Perfect circle area formed by a maximum diameter)/(Actual surface area). The surface roughness was obtained as an average value from a calculation of (Perfect circle area that forms a boundary length)/(Actual surface area).

(Specific Gravity)

The specific gravity was measured at normal temperature (25° C.) with a liquid phase as ethanol, using an automatic specific gravity measuring device MAT-7000 (Seishin Enterprise Co., Ltd.), which measures specific gravity based on a principle of a liquid phase substitution method.

(Barium Titanate Sample 1)

(First Process: Preparation of a Spherical Barium Titanate Precursor)

In a dissolution tank having a Teflon® wetted portion, 600 parts by weight of purified water and 285 parts by weight of barium hydroxide octahydrate (Kanto Chemical Co., Inc.) as a reagent were charged, and heated while being stirred by a pitched-blade paddle impeller. Thereby, an aqueous solution having a temperature of 80° C. (Solution B) was prepared. In a reaction tank having a Teflon® wetted portion, 560 parts by weight of n-butanol (Kanto Chemical Co., Inc.) and 220 parts by weight of tetra-n-butoxytitanium (Wako Pure Chemical Industries, Ltd.) as a reagent were charged, and gradually added with 200 parts by weight of purified water for hydrolysis while being stirred by a pitched-blade paddle impeller. Thereby, a titanium hydroxide slurry having a temperature of 25° C. (Solution A) was prepared. When the barium hydroxide solution (Solution B) was immediately added to the titanium hydroxide slurry (Solution A), the temperature rose up to 50° C. While being refluxed, the solution was heated up to a temperature of 90° C. at a temperature increase rate of 30° C. per hour, and was further aged for 1 hour at a temperature of 90° C. After being cooled, the solution was filtered through a filter paper (5C) placed on a buchner funnel while being sucked by an aspirator, and thereby a crystallized cake of separated substances was obtained. The cake obtained from the separation was transferred to a washing tank having a Teflon® wetted portion. Then, 300 parts by weight of an acetate solution having a concentration of 2% to 4% was added. After washing and filtration were repeated twice, the obtained cake was dried for 24 hours at a temperature of 105° C., whereby spherical barium titanate precursor powder of the first process was produced.

(Second Process: Preparation of Spherical Barium Titanate)

The spherical barium titanium precursor powder obtained in the first process was crushed by a roll mill, charged in a mullite saggar, and then calcined at a temperature of 850° C. for 4 hours. Aggregates formed in the dry process through the heat treatment process were removed by a jet mill so as to use them as samples. A mole ratio of barium and titanium (Ba/Ti) of the obtained samples was 1.004 according to an X-ray fluorescence analysis. The obtained barium titanate was referred to as Sample 1. Physical property values of the barium titanate are shown in Table 1. In addition, an electron microscope photograph of the obtained spherical barium titanate is shown in FIG. 1.

TABLE 1

| Barium titanate sample | SEM average particle size (μm) | BET specific surface area ($m^2/g$) | Sphericity | Surface roughness | Specific gravity |
|---|---|---|---|---|---|
| Sample 1 | 0.15 | 11.04 | 1.18 | 1.17 | 5.51 |

(Barium Titanate Sample 2)

In a coffee mill, 220 parts by weight of the powder of barium titanate Sample 1 was charged. 3-glycidoxypropyltrimethoxysilane (Shin-Etsu Chemical Co., Ltd.), whose hydrophobic group is categorized into epoxy, was dropped for a duration of 1 minute while being stirred. After being stirred for further 2 minutes, the treated powder was taken out, charged in the coffee mill again, stirred for 2 minutes, and then removed. As a result, the additive concentration of a hydrophobicizing agent was calculated as 1.35% by weight. The treated powder was let stand and dried for 20 hours at a temperature of 80° C.

While being dried, the hydrophobicizing agent, which underwent hydrolysis and dehydration/condensation, was fixed on a substrate surface of barium titanate. In a case of 3-glycidoxypropyltrimethoxysilane, the molecular weight was 74.1% of the weight before the dry treatment, due to desorption of methanol and water. A carbon amount was determined in a solid-phase TC measurement. Then, a fixing amount of the hydrophobicizing agent was calculated as 1.00% by weight. It was thus confirmed that fixing was obtained as defined as a theoretical FIGURE. Barium titanium having undergone coating treatment with the obtained hydrophobicizing agent was referred to as Sample 2.

(Barium Titanate Sample 3)

Barium titanate Sample 3 was obtained by performing the first and second processes of the preparation of barium titanate Sample 1 in a similar manner, except that the heat treatment of the second process was performed at a temperature of 1,050° C. for 4 hours. The physical property values of obtained barium titanate Sample 3 are shown in Table 2.

TABLE 2

| Barium titanate sample | SEM average particle size (μm) | BET specific surface area ($m^2/g$) | Sphe-ricity | Surface roughness | Specific gravity |
|---|---|---|---|---|---|
| Sample 3 | 0.66 | 2.60 | 1.60 | 1.39 | 5.90 |

(Barium Titanate Sample 4)

Barium titanate Sample 3 prepared as above underwent coating treatment with 3-glycidoxypropyltrimethoxysilane, similar to the preparation of barium titanate Sample 2. A fixing amount of the hydrophobicizing agent was calculated as 1.00% by weight. It was thus confirmed that fixing was obtained as defined as a theoretical FIGURE. Barium titanium having undergone coating treatment with the obtained hydrophobicizing agent was referred to as Sample 4.

(Barium Titanate Sample 5)

In a reaction tank having a Teflon® wetted portion, 720 parts by weight of purified water was put, and added with 106 parts by weight of barium carbonate (Kanto Chemical Co., Inc.) as a reagent while being stirred by a pitched-blade paddle impeller, and thereby a slurry was produced. In a preparation tank having a Teflon® wetted portion, 560 parts by weight of purified water was put, and added with 130 parts by weight of oxalic acid dehydrate (Kanto Chemical Co., Inc.) as a reagent while being stirred by a stir bar. Further, 256 parts by weight of an aqueous solution was added, the aqueous solution being obtained by diluting and controlling titanium tetrachloride (Osaka Titanium technologies Co., Ltd.) at a titanium oxide equivalent concentration of 15%. At this stage, a titanyl oxalate solution was obtained. While the barium carbonate slurry was maintained at a temperature of 25° C., the titanyl oxalate solution was added at a constant speed for a duration of 2 hours. After the addition, the solution was further stirred for 30 minutes. Then, the solution was filtered through a filter paper (5C) placed on a buchner funnel while being sucked by an aspirator, and thereby a cake of barium titanyl oxalate tetrahydrate separated in the reaction was obtained. The barium titanyl oxalate tetrahydrate cake was transferred to a washing tank having a Teflon® wetted portion. Then, 1,200 parts by weight of purified water was added and stirred, and repulp washing was performed for 30 minutes. The solution was filtered in a similar manner to the post-reaction process. Then, the obtained cake was dried at a temperature of 80° C. for 24 hours, whereby 215 parts by weight of dried powder of barium titanyl oxalate tetrahydrate was obtained. The obtained barium titanyl oxalate tetrahydrate had an average particle size of 12 μm, and a mole ratio of barium and titanium (Ba/Ti) was 1.003 according to an X-ray fluorescence analysis. The obtained barium titanyl oxalate tetrahydrate was charged in a mullite sagger (150 mm in diameter), and deoxalated through air at a temperature of 800° C. for 20 hours. A specific surface area of the obtained powder was 7.05 $m^2/g$. After being crushed for 10 minutes in a coffee mill, the powder was charged back in the mullite sagger, and calcined at a temperature of 950° C. for 20 hours. Aggregates formed in the heat treatment process were removed by a ball mill. Sixty grams of the heat-treated powder was charged in a container having a capacity of 700 ml, with 1,100 grams of $ZrO_2$ balls having a diameter of 5 mm and 100 grams of ethanol as a solvent. After the container was tightly closed, the substances were ground at a speed of 100 rpm for a duration of 4 hours. After the grinding, the entire substance, including balls, was dried. The powder was sieved from the balls and was further crushed in a coffee mill for 10 minutes. The obtained product was referred to as barium titanate Sample 5. The physical property values of obtained barium titanate Sample 5 are shown in Table 3.

TABLE 3

| Barium titanate sample | SEM average particle size (μm) | BET specific surface area ($m^2/g$) | Sphe-ricity | Surface roughness | Specific gravity |
|---|---|---|---|---|---|
| Sample 5 | 0.33 | 4.52 | 1.50 | 1.36 | 5.84 |

(Barium Titanate Sample 6)

Barium titanate Sample 5 prepared as above underwent coating treatment with 3-glycidoxypropyltrimethoxysilane, similar to the preparation of barium titanate Sample 2. A fixing amount of the hydrophobicizing agent was calculated as 1.00% by weight. It was thus confirmed that fixing was obtained as defined as a theoretical FIGURE. Barium titanium having undergone coating treatment with the obtained hydrophobicizing agent was referred to as Sample 6.

(Barium Titanate Sample 7)

Barium titanate Sample 7A was obtained in a manner similar to the preparation of barium titanate Sample 1, except that a burning condition of the second process was a temperature of 750° C. and a duration of 4 hours. The physical property values of obtained barium titanate Sample 7A are shown in Table 4.

TABLE 4

| Barium titanate sample | SEM average particle size (μm) | BET specific surface area ($m^2/g$) | Sphe-ricity | Surface roughness | Specific gravity |
|---|---|---|---|---|---|
| Sample 7A | 0.15 | 12.09 | 1.36 | 1.30 | 5.43 |

Barium titanate Sample 7A prepared as above underwent coating treatment with 3-glycidoxypropyltrimethoxysilane, similar to the preparation of barium titanate Sample 2. Barium titanium having undergone coating treatment with 1.0% by weight of 3-glycidoxypropyltrimethoxysilane was obtained as barium titanate Sample 7.

(Barium Titanate Sample 8)

Barium titanate Sample 8A was obtained in a manner similar to the preparation of barium titanate Sample 1, except that a burning condition of the second process was a temperature of 650° C. and a duration of 4 hours. The physical property values of obtained barium titanate Sample 8A are shown in Table 5.

TABLE 5

| Barium titanate sample | SEM average particle size (μm) | BET specific surface area ($m^2/g$) | Sphe-ricity | Surface roughness | Specific gravity |
|---|---|---|---|---|---|
| Sample 8A | 0.15 | 12.13 | 1.30 | 1.25 | 5.39 |

Barium titanate Sample 8A prepared as above underwent coating treatment with 3-glycidoxypropyltrimethoxysilane, similar to the preparation of barium titanate Sample 2. Barium titanium having undergone coating treatment with 1.0% by weight of 3-glycidoxypropyltrimethoxysilane was obtained as barium titanate Sample 8.

(Evaluation as an External Additive for Toner)

Examples 1 to 3, Reference Example 1, and Comparative Examples 1 to 4

One hundred parts by weight of polyester resin (Mn: 4300; Mw: 42000; Acid number: 6 mg KOH/g; Tg: 61° C.) and 5 parts by weight of pigments listed below were mixed using a Henschel mixer and were kneaded using a twin-screw kneading extruder, of which a cylinder temperature was set to 160° C. After being cooled, the obtained mixture was ground by a fine grinding mill using a jet mill, and was classified using an air current separator. Thereby, toner particles having an average particle size of 9 μm were obtained.

Pigment: Carbon black (black)

Pigment: Benzine pigment (yellow)

Pigment: Azo pigment (magenta)

Pigment: Copper phthalocyanine pigment (cyan)

Subsequently, 100 parts by weight of the toner particles obtained as above, 1.5 parts by weight of hydrophobic silica (Product name: Nippon Aerosil R-972), and 0.5 part by weight of each of the barium titanate samples prepared as above were fully mixed using a Henschel mixer, and then were filtered through a 100 mesh sieve. Thereby, respective toner samples were obtained.

Using the toner samples, test patterns were printed using a commercially available color laser printer in the following environments: normal temperature/normal humidity (20° C./50%), low temperature/low humidity (10° C./20%), and high temperature/high humidity (30° C./80%). Then, the 1,000$^{th}$ printout was evaluated for image density using a Macbeth densitometer and for background fog with a visual check. The background fog was evaluated as below.

Background Fog Evaluation

○: No fog

Δ: Slight fog

X: Significant fog

TABLE 6

| | BT sample type | Test condition Temperature/ humidity | Image density Magenta | Cyan | Yellow | Black | Background fog evaluation |
|---|---|---|---|---|---|---|---|
| Example 1 | Sample 2 | 20° C./50% | 1.38 | 1.44 | 1.5 | 1.57 | ○ |
| | | 10° C./20% | 1.2 | 1.28 | 1.29 | 1.47 | ○ |
| | | 30° C./80% | 1.57 | 1.60 | 1.50 | 1.63 | ○ |
| Example 2 | Sample 7 | 20° C./50% | 1.33 | 1.42 | 1.45 | 1.55 | ○ |
| | | 10° C./20% | 1.15 | 1.23 | 1.20 | 1.45 | ○ |
| | | 30° C./80% | 1.53 | 1.59 | 1.50 | 1.63 | ○ |
| Example 3 | Sample 8 | 20° C./50% | 1.35 | 1.43 | 1.49 | 1.56 | ○ |
| | | 10° C./20% | 1.18 | 1.25 | 1.25 | 1.45 | ○ |
| | | 30° C./80% | 1.55 | 1.60 | 1.50 | 1.63 | ○ |

Note)

In the table, "BT sample" indicates a barium titanium sample.

TABLE 7

| | BT sample type | Test condition Temperature/ humidity | Image density Magenta | Cyan | Yellow | Black | Background fog evaluation |
|---|---|---|---|---|---|---|---|
| Reference example 1 | Sample 1 | 20° C./50% | 1.29 | 1.37 | 1.39 | 1.6 | ○ |
| | | 10° C./20% | 0.95 | 1.1 | 1.12 | 1.47 | ○ |
| | | 30° C./80% | 1.49 | 1.59 | 1.47 | 1.63 | Δ |
| Comparative example 1 | Sample 3 | 20° C./50% | 1.11 | 1.28 | 1.35 | 1.47 | Δ |
| | | 10° C./20% | 0.89 | 0.98 | 1.1 | 1.39 | Δ |
| | | 30° C./80% | 1.32 | 1.45 | 1.45 | 1.57 | X |
| Comparative example 2 | Sample 4 | 20° C./50% | 1.21 | 1.29 | 1.45 | 1.47 | Δ |
| | | 10° C./20% | 0.95 | 1.21 | 1.2 | 1.42 | Δ |
| | | 30° C./80% | 1.35 | 1.46 | 1.49 | 1.49 | Δ |
| Comparative example 3 | Sample 5 | 20° C./50% | 1.21 | 1.28 | 1.43 | 1.49 | Δ |
| | | 10° C./20% | 0.97 | 1.2 | 1.1 | 1.34 | Δ |
| | | 30° C./80% | 1.31 | 1.43 | 1.45 | 1.45 | X |
| Comparative example 4 | Sample 6 | 20° C./50% | 1.31 | 1.28 | 1.45 | 1.5 | Δ |
| | | 10° C./20% | 0.97 | 1.23 | 1.24 | 1.36 | Δ |
| | | 30° C./80% | 1.44 | 1.49 | 1.45 | 1.49 | Δ |

Note)

In the table, "BT sample" indicates a barium titanium sample.

The results shown in Tables 6 and 7 demonstrated that the color printer that used toners externally added with the barium titanate according to the present invention concurrently achieved high image density and reduced background fog, and further retained high image quality even under a high-temperature high-humidity environment and a low-temperature low-humidity environment.

Blending the barium titanate external additive of the present invention particularly in a color toner enhances the toner fluidity, electrical properties, and other relevant performance; concurrently achieves high image density and reduced background fog in a color printer using the toner; and further retains high image quality even under a high-temperature high-humidity environment and a low-temperature low-humidity environment.

What is claimed is:

1. An external additive for toner comprising spherical barium titanate having undergone coating treatment with a hydrophobicizing agent, wherein the spherical barium titanate has a sphericity of 1.0 to 1.4, a surface roughness of 1.0 to 1.4, and a specific gravity of 5.0 to 5.5.

2. The external additive for toner according to claim 1, wherein the spherical barium titanate has an average particle size of 0.05 μm to 0.7 μm.

3. The external additive for toner according to claim 1, wherein the hydrophobicizing agent is a silane coupling agent.

4. A method of producing an external additive for toner, comprising:

a first process of reacting, in a solvent containing water and alcohol, titanium hydroxide obtained from hydrolysis of titanium alkoxide by water, and a barium compound, at a temperature which is increased from a temperature of 10° C. to 60° C. to a temperature of 80° C. to 100° C. at a rate of temperature increase of from 5° C. to 50° C./hour, and then held at 80° C. to 100° C., and conducting solid-liquid separation to form a spherical titanium hydroxide precursor powder;

a second process of heat treating the spherical titanium hydroxide precursor powder at a temperature of 400° C. to 900° C., so as to obtain spherical barium titanate; and a third process of contacting spherical barium titanate with a hydrophobicizing agent.

5. The producing method of the external additive for toner according to claim 4, wherein the solvent comprising water and alcohol used in the first process comprises 10 to 400 parts by weight of alcohol with respect to 100 parts by weight of water.

6. The producing method of the external additive for toner according to claim 4, wherein, Solution B is added to and reacted with Solution A in the first process, such that 10 to 400 parts by weight of alcohol (A1) is provided with respect to 100 parts by weight of water (A2+B1), the Solution B comprising the barium compound and water (B1), the Solution A comprising the titanium hydroxide, which is obtained from the hydrolysis of titanium alkoxide by water, alcohol (A1), and water (A2).

* * * * *